US011309102B2

(12) United States Patent
Jang et al.

(10) Patent No.: US 11,309,102 B2
(45) Date of Patent: Apr. 19, 2022

(54) POWER CABLE

(71) Applicant: LS CABLE & SYSTEM LTD., Anyang-si (KR)

(72) Inventors: Sung Woo Jang, Donghae-si (KR); Jae Cheol Gwag, Daegu (KR)

(73) Assignee: LS CABLE & SYSTEM LTD., Anyang-si (KR)

( * ) Notice: Subject to any disclaimer, the term of this patent is extended or adjusted under 35 U.S.C. 154(b) by 582 days.

(21) Appl. No.: 16/326,013

(22) PCT Filed: Mar. 30, 2017

(86) PCT No.: PCT/KR2017/003524
§ 371 (c)(1),
(2) Date: Feb. 15, 2019

(87) PCT Pub. No.: WO2018/034404
PCT Pub. Date: Feb. 22, 2018

(65) Prior Publication Data

US 2021/0335517 A1 Oct. 28, 2021

(30) Foreign Application Priority Data

Aug. 18, 2016 (KR) ..... 10-2016-0105069

(51) Int. Cl.
*H01B 1/04* (2006.01)
*H01B 3/20* (2006.01)
(Continued)

(52) U.S. Cl.
CPC ..... *H01B 3/48* (2013.01); *H01B 1/04* (2013.01); *H01B 3/20* (2013.01); *H01B 7/0225* (2013.01); *H01B 7/1875* (2013.01); *H01B 7/14* (2013.01)

(58) Field of Classification Search
CPC ... H01B 1/04; H01B 3/20; H01B 3/48; H01B 7/02; H01B 7/0225; H01B 7/14;
(Continued)

(56) References Cited

U.S. PATENT DOCUMENTS 2,019,297 A 10/1935 Faucett
3,219,501 A * 11/1965 Volk ..... H01B 13/22 156/53
(Continued)

FOREIGN PATENT DOCUMENTS

EP 0129755 A1 1/1985
EP 0129755 A1 * 1/1985 ..... H01B 9/06
(Continued)

OTHER PUBLICATIONS

Problemas, et al.; "Power Quality Problems Caused by Termites on 138-kV Underground Cables"; vol. 31, No. 2; Oct. 2011; (5 pages).
(Continued)

*Primary Examiner* — Timothy J Thompson
*Assistant Examiner* — Guillermo J Egoavil
(74) *Attorney, Agent, or Firm* — K&L Gates LLP

(57) ABSTRACT

Provided is a power cable, and more particularly, to an ultra-high-voltage underground or submarine cable. In detail, the present invention relates to a power cable which is capable of effectively preventing a decrease in dielectric strength due to penetration of copper powder from a copper conductor into an insulating layer, thereby increasing the lifespan thereof, is capable of preventing damage to insulating paper, semiconductor paper, etc. even when repeatedly bent and unfolded, thereby maintaining an interlayer structure formed by winding the insulating paper, the semiconductor paper, etc., and is capable of improving bendability, flexibility, installability, workability, etc.

12 Claims, 2 Drawing Sheets

(51) Int. Cl.

| | |
|---|---|
| ***H01B 3/48*** | (2006.01) |
| ***H01B 7/02*** | (2006.01) |
| ***H01B 7/18*** | (2006.01) |
| *H01B 7/14* | (2006.01) |

(58) Field of Classification Search

CPC ..... H01B 7/18; H01B 7/1875; H01B 9/00; H01B 9/02

USPC ..... 174/71 C

See application file for complete search history.

(56) References Cited

U.S. PATENT DOCUMENTS

| | | | | |
|---|---|---|---|---|
| 4,417,093 | A * | 11/1983 | Occhini | H01B 3/20 174/25 C |
| 5,235,299 | A | 8/1993 | Vaille et al. | |
| 2001/0042635 | A1* | 11/2001 | Kondo | H01B 3/441 174/110 R |
| 2012/0285725 | A1* | 11/2012 | Maritano | H01B 3/52 174/120 FP |

FOREIGN PATENT DOCUMENTS

| | | | | |
|---|---|---|---|---|
| EP | 0428026 | A2 * | 5/1991 | H01Q 13/20 |
| EP | 2214279 | A2 * | 8/2010 | H02G 15/007 |
| GB | 906631 | A | 9/1962 | |
| GB | 2091030 | A | 7/1982 | |
| JP | 2000322935 | A | 11/2000 | |
| JP | 2000322935 | A * | 11/2000 | H01B 3/52 |
| JP | 2000353433 | A * | 12/2000 | H01B 3/52 |
| JP | 2011118353 | A * | 6/2011 | G02B 6/44 |
| KR | 10-1998-0042478 | A | 8/1998 | |
| KR | 10-2009-0043198 | A | 5/2009 | |
| KR | 10-1102100 | B1 | 1/2012 | |
| KR | 10-2015-0126736 | A | 12/2015 | |
| KR | 10-2015-0143086 | A | 12/2015 | |
| WO | WO-2013075756 | A1 * | 5/2013 | H01B 7/02 |

OTHER PUBLICATIONS

Extended European Search Report for related European Application No. 17841588.1; action dated Mar. 12, 2012; (10 pages).

International Search Report for related International Application No. PCT/KR2017/003524; action dated Aug. 16, 2017; (5 pages).

Written Opinion for related International Application No. PCT/KR2017/003524; action dated Aug. 16, 2017; (6 pages).

* cited by examiner

[Fig. 1] <Prior Art>
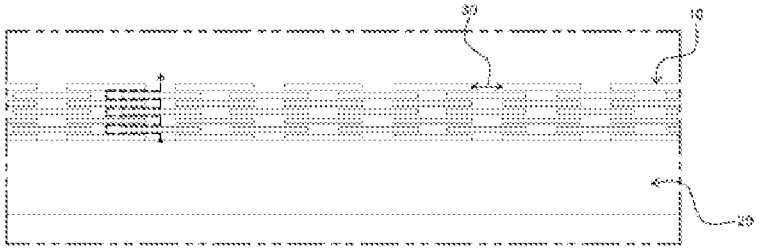
[Fig. 2]
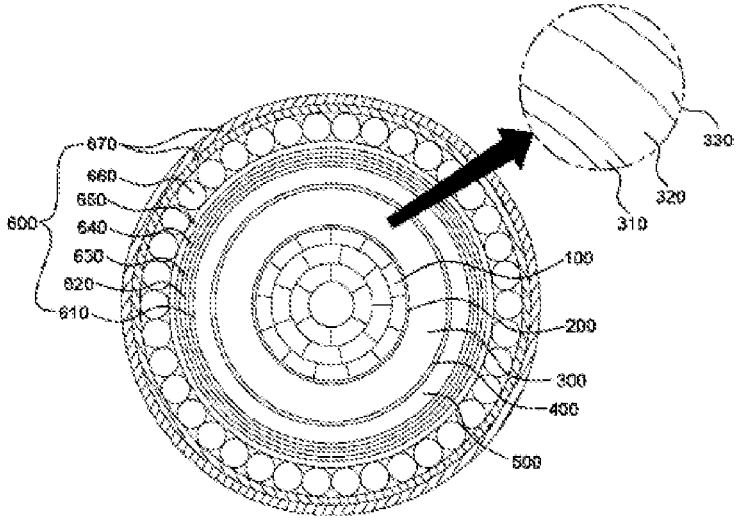

[Fig. 3]
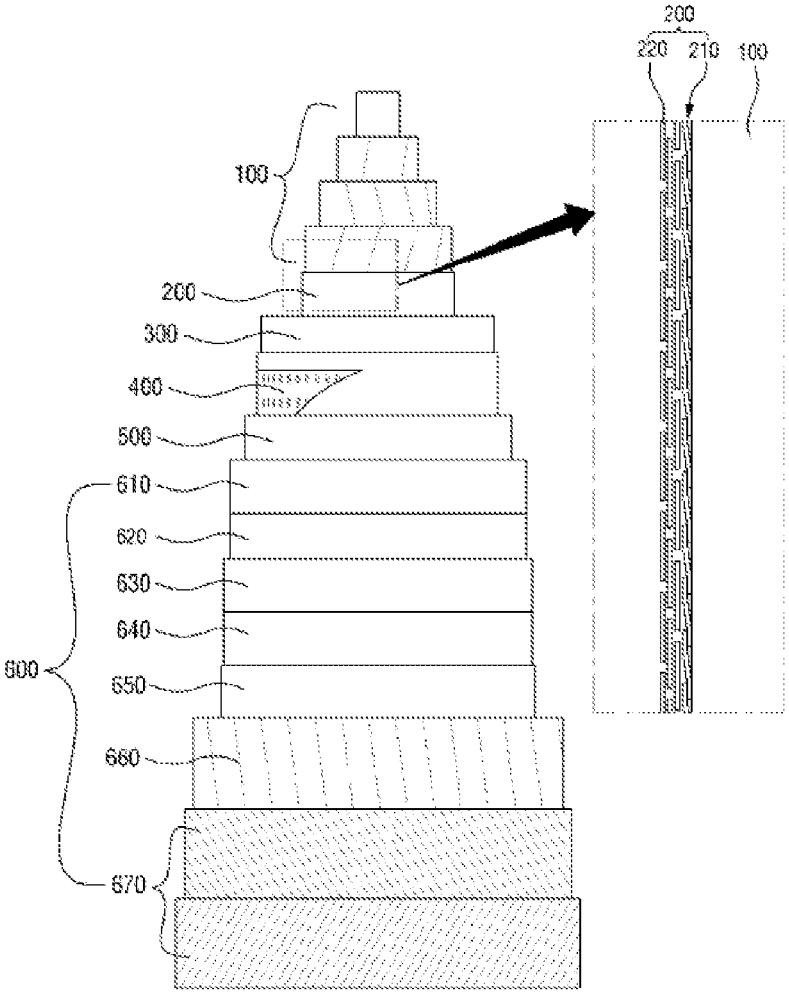

POWER CABLE

CROSS-REFERENCE TO RELATED APPLICATIONS

The present application is a National Stage of International Application No. PCT/KR2017/003524, filed Mar. 30, 2017, which claims priority to Korean Application No. 10-2016-0105069, filed Aug. 18, 2018, the disclosure of which are incorporated herein by reference.

TECHNICAL FIELD

The present invention relates to a power cable, and more particularly, to an ultra-high-voltage underground or submarine cable. In detail, the present invention relates to a power cable which is capable of effectively preventing a decrease in dielectric strength due to penetration of copper powder from a copper conductor into an insulating layer, thereby increasing the lifespan thereof, is capable of preventing damage to insulating paper, semiconductor paper, etc. even when repeatedly bent and unfolded, thereby maintaining an interlayer structure formed by winding the insulating paper, the semiconductor paper, etc., and is capable of improving bendability, flexibility, installability, workability, etc.

BACKGROUND ART

Power cables employing a polymeric insulator, such as cross-linked polyethylene (XLPE), as an insulating layer have been used. However, due to space charges formed at a direct-current (DC) high electric field, paper-insulated cables having an insulating layer formed by impregnating insulating paper horizontally wound to cover a conductor, etc. with insulating oil have been used as ultra-high-voltage DC transmission cables.

Examples of the paper-insulated cables include an oil-filled (OF) cable in which low-viscosity insulating oil is circulated, a mass-impregnated non-draining (MIND) cable impregnated with high-viscosity insulating oil, etc. The OF cable is limited in terms a degree of transfer of a hydraulic pressure for circulation of the insulating oil and thus is not suitable as a long-distance transmission cable. Particularly, the OF cable is not suitable as a submarine cable since it is difficult to install insulating oil circulation facility at the sea bottom.

Accordingly, the MIND cable is generally used as a long-distance DC transmission cable or an ultra-high-voltage submarine cable.

In the MIND cable, an insulating layer is formed by winding insulating paper, e.g., kraft paper or semi-synthetic paper formed by stacking kraft paper and thermoplastic resin such as polypropylene resin, in a plurality of layers. An inner semi-conductive layer below the insulating layer may be formed by winding semi-conductive paper, such as carbon black paper, in a plurality of layers. As illustrated in FIG. 1, gap winding is generally used when a plurality of layers are formed by horizontally winding semi-conductive paper 10 around a conductor part 20, such that regular gaps 30 are formed between portions of the semi-conductive paper 10 horizontally wound to form the plurality of layers and the gaps 30 in a certain layer are covered with portions of the semi-conductive paper 10 forming layers above and below the layer. Similarly, when the insulating layer is formed by winding the insulating paper, gap winding is generally used to secure a moving path of insulating oil when the insulating paper is impregnated with the insulating oil.

It is advantageous to form the insulating layer and an inner semi-conductive layer of the MIND cable by gap-winding insulating paper, semi-conductive paper, or the like as described above, in terms of securing the moving path of the insulating oil when the insulating paper or the semi-conductive paper is impregnated with the insulating oil. However, as illustrated in FIG. 1, copper powder may be dispersed in the insulating oil from a copper conductor of the conductor part 20, particularly, a stranded copper conductor, and then easily penetrate into the insulating layer as the insulating oil moves, thereby greatly deteriorating dielectric strength.

Accordingly, there is a desperate need for a power cable which is capable of effectively preventing deterioration of dielectric strength due to penetration of copper powder from a copper conductor into an insulating layer, thereby increasing lifespan thereof, is capable of suppressing damage to insulating paper, semi-conductive paper, or the like even when repeatedly bent and unfolded, thereby maintaining an interlayer structure formed by winding the insulating paper, the semi-conductive paper, or the like, and is capable of improving bendability, flexibility, installability, workability, etc.

DETAILED DESCRIPTION OF THE INVENTION

Technical Problem

The present invention is directed to providing a power cable capable of effectively preventing deterioration of dielectric strength due to penetration of copper powder from a copper conductor into an insulating layer, thereby increasing lifespan thereof.

The present invention also directed to providing a power cable capable of suppressing damage to insulating paper, semi-conductive paper, or the like even when repeatedly bent and unfolded, thereby maintaining an interlayer structure formed by winding the insulating paper, the semi-conductive paper, or the like.

The present invention is also directed to providing a power cable capable of improving bendability, flexibility, installability, workability, etc.

Technical Solution

According to an aspect of the present invention, there is provided a power cable comprising: a conductor; an inner semi-conductive layer covering the conductor; an insulating layer covering the inner semi-conductive layer; an outer semi-conductive layer covering the insulating layer; a metal sheath layer covering the outer semi-conductive layer; and a cable protection layer covering the metal sheath layer, wherein the inner semi-conductive layer comprises a plurality of layers formed by horizontally winding semi-conductive paper, wherein the plurality of layers comprise at least one layer formed by overlap-winding the semi-conductive paper such that portions of a width of the semi-conductive paper overlap each other, when the semi-conductive paper is horizontally wound.

According to another aspect of the present invention, there is provided the power cable, wherein the remaining layers among the plurality of layers other than the at least one layer formed by overlap-winding the semi-conductive paper comprise layers formed by gap-winding semi-conductive paper such that regular gaps are formed between portions of the semi-conductive paper horizontally wound and the gaps in a certain layer are covered with sheets of semi-conductive paper forming layers above and below the layer.

According to another aspect of the present invention, there is provided the power cable, wherein the at least one layer formed by overlap-winding the semi-conductive paper comprises a layer directly above the conductor.

According to another aspect of the present invention, there is provided the power cable, wherein an overlap ratio of the at least one layer formed by overlap-winding the semi-conductive paper is in a range of 20 to 80%, the overlap ratio being a ratio between overlapping portions of the semi-conductive paper and a width of the semi-conductive paper.

According to another aspect of the present invention, there is provided the power cable, wherein the number of the plurality of layers of the semi-conductive paper is in a range of 4 to 10, a total width of the inner semi-conductive layer is in a range of 0.2 to 1.5 mm, and the semi-conductive paper has a width of 15 to 30 mm.

According to another aspect of the present invention, there is provided the power cable, wherein the semi-conductive paper comprises carbon paper obtained by processing insulating paper with carbon black.

According to another aspect of the present invention, there is provided the power cable, wherein the insulating layer comprises a plurality of layers formed by horizontally winding insulating paper, wherein the plurality of layers comprise layers formed by gap-winding the insulating paper such that regular gaps are formed between portions of the insulating paper horizontally wound and the gaps in a certain layer are covered with sheets of insulating paper forming layers above and below the layer.

According to another aspect of the present invention, there is provided the power cable, wherein the insulating layer comprises an inner insulating layer, an intermediate insulating layer, and an outer insulating layer which are sequentially stacked, wherein each of the inner insulating layer and the outer insulating layer is formed of kraft paper impregnated with insulating oil, the intermediate insulating layer is formed by semi-synthetic paper impregnated with the insulating oil, wherein the semi-synthetic paper comprises: a plastic film; and kraft paper stacked on at least one surface of the plastic film, and the inner insulating layer and the outer insulating layer have resistivity lower than that of the intermediate insulating layer.

According to another aspect of the present invention, there is provided the power cable, wherein a thickness of the inner insulating layer is 1 to 10% of a total thickness of the insulating layer, a thickness of the intermediate insulating layer is 75% or more of the total thickness of the insulating layer, and a thickness of the outer insulating layer is 5 to 15% of the total thickness of the insulating layer.

According to another aspect of the present invention, there is provided the power cable, wherein the thickness of the outer insulating layer is greater than that of the inner insulating layer.

According to another aspect of the present invention, there is provided the power cable, wherein the cable protection layer comprises an inner sheath, bedding layers, a metal reinforcement layer, and an outer sheath.

According to another aspect of the present invention, there is provided the power cable, wherein the cable protection layer further comprises a wire sheath and an outer serving layer.

Advantageous Effects

In a power cable according to the present invention, at least one of a plurality of layers formed during winding of semi-conductive paper to form an inner semi-conductive layer on a conductor part is formed by overlap winding the semi-conductive paper, and thus, dielectric strength can be effectively prevented from deteriorating due to penetration of copper powder from a copper conductor of the conductor part into an insulating layer, thereby increasing the lifespan of the power cable.

In the power cable according to the present invention, at least one among a plurality of layers formed by winding semi-conductive paper is formed by precisely adjusting an overlap ratio of overlapping portions of the semi-conductive paper that is overlap-wound, and the other layers are formed by gap-winding the semi-conductive paper. Accordingly, it is possible to suppress damage to the semi-conductive paper even when repeatedly bent and unfolded, thereby maintaining an interlayer structure formed by winding the semi-conductive paper.

Furthermore, the bendability, flexibility, installability, workability, etc. of the power cable according to the present invention can be improved by preventing an unnecessary increase in an outer diameter thereof.

DESCRIPTION OF THE DRAWINGS

FIG. 1 is a schematic view of a power cable of the related art, in which semi-conductive paper is wound around a conductor part by gap winding, and copper powder from the conductor part penetrate into an insulating layer on a semi-conductive layer in a moving path of insulating oil, which is formed due to gap winding.

FIG. 2 is a schematic cross-sectional view of a power cable according to an embodiment of the present invention.

FIG. 3 is a schematic longitudinal sectional view of the power cable illustrated in FIG. 2.

MODE OF THE INVENTION

Hereinafter, exemplary embodiments of the present invention will be described in detail. The present invention is, however, not limited thereto and may be embodied in many different forms. Rather, the embodiments set forth herein are provided so that this disclosure will be thorough and complete, and fully convey the scope of the invention to those skilled in the art. Throughout the specification, the same reference numbers represent the same elements.

FIGS. 2 and 3 are schematic cross-sectional and longitudinal sectional views of a power cable according to an embodiment of the present invention.

As illustrated in FIGS. 2 and 3, a power cable according to the present invention may include a conductor 100, an inner semi-conductive layer 200 covering the conductor 100, an insulating layer 300 covering the inner semi-conductive layer 200, an outer semi-conductive layer 400 covering the insulating layer 300, a metal sheath layer 500 covering the outer semi-conductive layer 400, a cable protection layer 600 covering the metal sheath layer 500, etc.

The conductor 100 may serve as a current moving path for transmission of current, and may be formed of high-purity copper (Cu), aluminum (Al), or the like having high conductivity to minimize power loss and having appropriate strength and flexibility required to be used as a conductor of a cable, and particularly, annealed copper wire having high elongation and high conductivity. A cross-sectional area of the conductor 100 may vary according to the amount of power to be transmitted, use, etc. of a power cable.

Preferably, the conductor 100 may include a flat conductor formed by stacking flat wires in a plurality of layers on a circular center wire, or a circularly compressed conductor formed by stacking round wires in a plurality of layers on a circular center wire and compressing the round wires. The conductor 100 which includes a flat conductor formed by a so-called keystone method is economical, since an outer diameter of the cable may be reduced due to a high space factor of the conductor 100 and the cross-sectional area of each wire of the conductor 100 may be increased to reduce the total number of wires.

The inner semi-conductive layer 200 may suppress a non-uniform distribution of discharges on a surface of the conductor 100, alleviate a distribution of electric field inside the cable, and remove a gap between the conductor 100 and the insulating layer 300, thereby suppressing a partial discharge, dielectric breakdown, etc.

As illustrated in FIG. 3, the inner semi-conductive layer 200 may be formed by, for example, winding semi-conductive paper, such as carbon paper obtained by processing insulating paper with conductive carbon black, in a plurality of layers. At least one layer 210 among the plurality of layers of the semi-conductive paper may be formed by overlap-winding the semi-conductive paper, i.e., by horizontally winding the semi-conductive paper such that portions of a width of the semi-conductive paper overlap each other. The other layers 220 may be formed by gap-winding the semi-conductive paper, such that gaps are formed between portions of the wound semi-conductive paper and gaps in a certain layer are covered with semi-conductive paper forming layers above and below the layer. Preferably, at least one layer formed by overlap-winding the semi-conductive paper may include a lowermost layer, i.e., a layer that is in contact with the conductor 100.

The layer 210 formed by overlap-winding the semi-conductive paper does not have a gap therein, i.e., a path in which copper powder from the conductor 100 may move, unlike the layers 220 formed by gap-winding the semi-conductive paper, and thus may suppress the movement of the copper powder to the insulating layer 300 via the inner semi-conductive layer 200, thereby effectively suppressing deterioration of dielectric strength of the insulating layer 300 due to the copper powder. Accordingly, the lifespan of the power cable may be improved, and at the same time, unnecessary increase of an outer diameter of the power cable may be avoided, thereby improving bendability, flexibility, installability, workability, etc.

Furthermore, the layers 220 formed by gap-winding the semi-conductive paper, other than the layer 210 formed by overlap-winding the semi-conductive paper, may allow semi-conductive paper forming a certain layer to stably slide between sheets of semi-conductive paper forming layers above and below the layer. Thus, even when the power cable is repeatedly bent and unfolded, friction or collision between sheets of adjacent semi-conductive paper may be prevented to suppress damage to the semi-conductive paper and stably maintain the structure of the inner semi-conductive layer 200.

Preferably, the layer 210 formed by overlap-winding the semi-conductive paper may be a lowermost layer, i.e., a layer directly above the conductor 100, so that the movement of copper powder from the conductor 100 may be fundamentally blocked, and overlapping portions of sheets of adjacent semi-conductive paper may be suppressed from being separated from each other even when an overlap ratio of the overlapping portions of the sheets of semi-conductive paper during the overlap-winding of the sheets of semi-conductive paper is minimized. Accordingly, a collision between the sheets of semi-conductive paper during the bending or unfolding of the power cable may be prevented and thus damage to the sheets of semi-conductive paper may be suppressed, thereby stably maintaining the structure of the inner semi-conductive layer 200.

Here, the number of the plurality of layers of the semi-conductive paper may be in a range of 4 to 10 and thus the total thickness of the inner semi-conductive layer 200 may be in a range of about 0.2 to 1.5 mm. The semi-conductive paper may have a width of about 15 to 30 mm. During the overlap winding of the semi-conductive paper, the overlap ratio may vary according to the outer diameter of the conductor 100, the width of the semi-conductive paper, and the position of the layer 210 formed on the inner semi-conductive layer 200 by overlap-winding the semi-conductive paper, and may be, for example, in a range of about 20 to 50%.

If the overlap ratio is less than 20% when the semi-conductive paper is overlap-wound, the overlapping portions of the semi-conductive paper may be separated from each other when the power cable is bent, and the semi-conductive paper may be damaged due to collision when the separated portions overlap each other again when the power cable is unfolded. In contrast, if the overlap ratio is greater than 50%, portions of the semi-conductive paper may unnecessarily excessively overlap each other and thus the productivity of the power cable may decrease and the outer diameter thereof may unnecessarily increase, thereby decreasing bendability, flexibility, installability, workability, etc.

During the formation of the inner semi-conductive layer 200, two or more sheets of the semi-conductive paper may be simultaneously overlap-wound to continuously form layers by overlap-winding and gap-winding the semi-conductive paper.

The insulating layer 300 may include an inner insulating layer 310, an intermediate insulating layer 320, and an outer insulating layer 330. The inner insulating layer 310 and the outer insulating layer 330 may be formed of a material having lower resistivity than that of the intermediate insulating layer 320. Thus, the inner insulating layer 310 and the outer insulating layer 330 may alleviate an electric field to suppress a high electric field, which is formed by current flowing through the conductor 100 during the operation of the cable, from being applied directly above the conductor 100 or directly below the metal sheath layer 500, and may suppress deterioration of the intermediate insulating layer 320.

According to an embodiment of the present invention, the inner insulating layer 310 and the outer insulating layer 330 may be formed by horizontally winding kraft paper made of kraft pulp and impregnating the kraft paper with insulating oil. Thus, the inner insulating layer 310 and the outer insulating layer 330 may have lower resistivity and higher dielectric constant than those of the intermediate insulating layer 320. The kraft paper may be manufactured by removing an organic electrolyte in the kraft pulp and washing the kraft pulp with deionized water to obtain high dielectric tangent and high permittivity.

The intermediate insulating layer 320 may be formed by horizontally winding semi-synthetic paper, which is obtained by stacking kraft paper on an upper surface of a plastic film, a lower surface thereof, or both of them, and then impregnating the semi-synthetic paper with insulating oil. In this case, the intermediate insulating layer 320 includes the plastic film and thus has higher resistivity and a lower dielectric constant than those of the inner insulating layer 310 and the outer insulating layer 330. The outer diameter of the cable may be reduced due to the higher resistivity of the intermediate insulating layer 320.

Here, the kraft paper or the semi-synthetic paper used to form each of the inner insulating layer 310, the intermediate insulating layer 320, and the outer insulating layer 330 is preferably horizontally wound by gap winding, so that when impregnated with the insulating oil, a moving path of the insulating oil may be easily secured to decrease an impregnation time, and damage to the kraft paper or the semi-synthetic paper may be effectively suppressed even when the power cable is repeatedly bent and unfolded.

The plastic film of the semi-synthetic paper used to form the intermediate insulating layer 320 is heated during the operation of the cable and thus suppresses the movement of the insulating oil impregnated in the insulating layer 300 toward the outer semi-conductive layer 400, thereby suppressing generation of de-oiling voids due to the movement of the insulating oil. Consequently, electric field concentration and dielectric breakdown due to the de-oiling voids may be suppressed. Here, the plastic film may be formed of a polyolefin resin, such as polyethylene, polypropylene or polybutylene, or a fluororesin, such as a tetrafluoroethylene-hexafluoropropylene copolymer or an ethylene-tetrafluoroethylene copolymer, and preferably, a polypropylene homopolymer resin having high heat resistance.

A thickness of the plastic film of the semi-synthetic paper may be 40 to 70% of a total thickness of the semi-synthetic paper. When the thickness of the plastic film is less than 40% of the total thickness of the semi-synthetic paper, the resistance of the intermediate insulating layer 320 may be insufficient and thus the outer diameter of the cable may increase. In contrast, when the thickness of the plastic film is greater than 70%, a high electric field may be applied to the intermediate insulating layer 320.

A thickness of the inner insulating layer 310 may be 1 to 10% of the total thickness of the insulating layer 300. A thickness of the outer insulating layer 330 may be 5 to 15% of the total thickness of the insulating layer 300. A thickness of the intermediate insulating layer 320 may be 75% or more of the total thickness of the insulating layer 300. Thus, a maximum impulse electric-field value of the inner insulating layer 310 may be lower than that of the intermediate insulating layer 320. When the thickness of the inner insulating layer 310 is increased more than necessary, the maximum impulse electric-field value of the inner insulating layer 310 becomes greater than that of the intermediate insulating layer 320 and thus the outer diameter of the cable increases. Furthermore, the outer insulating layer 330 is preferably sufficiently thicker than the inner insulating layer 310, as will be described later.

In the present invention, the inner insulating layer 310 and the outer insulating layer 330 each having low resistivity are provided to suppress a high electric field from being applied directly above the conductor 100 and directly below the metal sheath layer 500, and the intermediate insulating layer 320 having high resistivity is designed to have a thickness of 75% or more and thus the outer diameter of the cable may be reduced.

As described above, the thicknesses of the inner insulating layer 310, the intermediate insulating layer 320 and the outer insulating layer 330 of the insulating layer 300 are precisely controlled as described above, thereby achieving desired dielectric strength of the insulating layer 300 and minimizing the outer diameter of the cable. In addition, an electric field to be applied to the insulating layer 300 may be most effectively buffered to suppress a high electric field from being applied directly above the conductor 100 and below the metallic sheath layer 500, and thus deterioration of dielectric strength and other properties of cable connection parts which are especially vulnerable to an electric field may be avoided.

Preferably, the thickness of the outer insulating layer 330 may be greater than that of the inner insulating layer 310. For example, the inner insulating layer 310 may have a thickness of 0.1 to 2.0 mm, the outer insulating layer 330 may have a thickness of 1.0 to 3.0 mm, and the intermediate insulating layer 320 may have a thickness of 15 to 25 mm.

Heat generated during a plumbing work for connection of the cable according to the present invention may be applied to the insulating layer 300 and thus the plastic film of the semi-synthetic paper used to form the intermediate insulating layer 320 may melt. Thus, it is necessary to secure a sufficient thickness of the outer insulating layer 330 to protect the plastic film from the heat. The outer insulating layer 330 is preferably formed to be thicker than the inner insulating layer 310. The thickness of the outer insulating layer 330 may be 1.5 to 30 times than that of the inner insulating layer 310.

The semi-synthetic paper used to form the intermediate insulating layer 320 may have a thickness of 70 to 200 μm. The kraft paper used to form each of the inner and outer insulating layers 310 and 320 may have a thickness of 50 to 150 μm.

The kraft paper used to form each of the inner and outer insulating layers 310 and 320 is formed to be thicker than the kraft paper constituting the semi-synthetic paper.

When the kraft paper used to form each of the inner and outer insulating layers 310 and 320 is excessively thin, the kraft paper may be damaged due to insufficient strength thereof when horizontally wound, and a number of times of horizontally winding the kraft paper may be increased to form the insulating layer 300 to a desired thickness, thereby decreasing productivity. In contrast, when the kraft paper is excessively thick, the total volume of gaps between portions of the kraft paper when horizontally wound may decrease, and thus, it may take a long time to impregnate the kraft paper with the insulating oil and it may be difficult to achieve desired dielectric strength due to a decrease of the content of the insulating oil impregnated in the kraft paper.

The insulating oil impregnated in the insulating layer 300 is not circulated but is fixed, unlike the insulating oil used for the conventional OF cable. Thus, high-viscosity insulating oil having relatively high viscosity is used. The insulating oil may be used to not only achieve the desired dielectric strength of the insulating layer 300 but also to act as a lubricant to facilitate the movement of the insulating paper when the cable is bent.

The insulating oil is not particularly limited, but it should not be oxidized by heat when in contact with copper and aluminum constituting the conductor 100, should have sufficiently low viscosity at impregnation temperature, e.g., 100° C. or more, to facilitate impregnation of the insulating layer 300 with the insulating oil, and should have sufficiently high viscosity at operating temperature, e.g., 80 to 90° C., not to melt during the operation of the cable. For example, high-viscosity insulating oil having a coefficient of viscosity of 500 centistokes or more at 60° C., and particularly, at least one insulating oil selected from the group consisting of naphthene-based insulating oil, polystyrene-based insulating oil, mineral oil, alkylbenzene or polybutene-based synthetic oil, and heavy alkylate may be used.

A process of impregnating the insulating layer 300 with the insulating oil may be performed by horizontally winding the kraft paper and the semi-synthetic paper a plurality of times to form the inner insulating layer 310, the intermediate insulating layer 320, and the outer insulating layer 330 to desired thicknesses, vacuum-drying them to remove moisture, foreign substances, etc. from the insulating layer 300, impregnating them with the insulating oil heated to the impregnation temperature, e.g., 100 to 120° C., for a certain time under a high-pressure environment, and then gradually cooling them.

The outer semi-conductive layer 400 may alleviate an electric-field distribution by suppressing a non-uniform charge distribution between the insulating layer 300 and the metal sheath layer 500, and may physically protect the insulating layer 300 from various types of metal sheath layers 500.

The outer semi-conductive layer 400 may be formed by, for example, horizontally winding semi-conductive paper, such as carbon paper obtained by processing insulating paper with conductive carbon black, or metallized paper obtained by stacking a thin aluminum film on kraft paper. The outer semi-conductive layer 400 may have a thickness of about 0.1 to 1.5 mm. In particular, the metallized paper may have a plurality of perforations so that the insulating layer 300 below the outer semi-conductive layer 400 may be easily impregnated with the insulating oil.

The metal sheath layer 500 uniformizes an electric field inside the insulating layer 300, prevents the electric field from being discharged to the outside of the cable so that an electrostatic shielding effect may be obtained, grounds an end of the cable to function as a return path of fault current when grounding or a short-circuit occurs in the cable, thereby securing safety, protects the cable from external impacts, pressure, etc., and improves watertightness and flame retardancy of the cable.

The metal sheath layer 500 may be, for example, a lead covered sheath formed of a lead alloy. As the metal sheath layer 500, the lead covered sheath may also serve as a shielding board for high current due to relatively low electrical resistance thereof, and may additionally improve watertightness, mechanical strength, fatigue characteristics, etc. of the cable when formed as a seamless type.

Furthermore, a corrosion inhibiting compound such as blown asphalt may be applied on a surface of the lead covered sheath to additionally improve the corrosion resistance, watertightness, etc. of the cable and to increase the adhesion between the metal sheath layer 500 and the cable protection layer 600.

The cable protection layer 600 may include, for example, an inner sheath 610, a metal reinforcement layer 630, bedding layers 620 and 640 above and below the metal reinforcement layer 630, and an outer sheath 650. Here, the inner sheath 610 improves the corrosion resistance, watertightness, etc. of the cable, and protects the cable from mechanical trauma, heat, fire, ultraviolet rays, insects or animals. The inner sheath 610 is not particularly limited, but may be formed of polyethylene having high cold resistance, oil resistance, chemical resistance, etc., polyvinyl chloride having high chemical resistance and flame retardancy, or the like.

The metal reinforcement layer 630 may protect the cable from mechanical impacts, and may be formed of galvanized steel tape to prevent corrosion. A corrosion inhibiting compound may be applied on a surface of the galvanized steel tape. The bedding layers 620 and 640 above and below the metal reinforcement layer 630 may buffer external impacts, pressure, etc. and may be formed, for example, of nonwoven fabric tape.

The outer sheath 650 has substantially the same function and characteristics as the inner sheath 610. The outer sheath 650 may be formed of polyvinyl chloride having excellent flame retardancy when the cable is used in a submarine tunnel, a terrestrial tunnel section, etc., where fire is a risk factor that greatly affects manpower or equipment safety, and may be formed of polyethylene having excellent mechanical strength and cold resistance when the cable is used in a pipe conduct section.

In addition, when the cable is a submarine cable, the cable protection layer 600 may further include a wire sheath 660, an outer serving layer 670 formed of, for example, polypropylene yarn, and the like. The wire sheath 660 and the outer serving layer 670 may additionally protect the cable from sea currents, reefs, etc. at the sea bottom.

Examples

1. Preparation Example

Power cable samples having a structure as described above with reference to FIGS. 2 and 3 were prepared. Particularly, a power cable sample according to an example, in which a lowermost layer among a plurality of layers of semi-conductive paper used to form an inner semi-conductive layer, i.e., a layer directly above a conductor, was formed by overlap-winding the semi-conductive paper, and the other layers were formed by gap-winding the semi-conductive paper, and a power cable sample of a comparative example, in which all a plurality of layers of semi-conductive paper used to form an inner semi-conductive layer were formed by gap-winding the semi-conductive paper were prepared.

2. Evaluation of Whether Copper Powder Moved or not

Each of the power cable samples of the example and the comparative example was heated for about 7 hours by supplying current to a conductor thereof, maintained at 80° C. for 1 hour, and cooled at room temperature for 16 hours. Then, an insulating layer of each of the power cable samples was separated, and it was evaluated with naked eyes whether copper powder from a copper conductor penetrated into the insulating layer via the inner semi-conductive layer as insulating oil shrank and expanded.

A result of the evaluation revealed that copper powder inside the insulating layer was not observed in the power cable sample of the example having the layer formed by overlap-winding the semi-conductive paper and thus it was determined that the movement of the copper powder from the copper conductor was effectively blocked by the layer of the inner semi-conductive layer which was formed by overlap-winding the semi-conductive paper. In contrast, a large amount of the copper powder inside the insulating layer was observed in the power cable sample of the comparative example having only the layers formed by gap-winding the semi-conductive paper and thus it was determined that the copper powder from the copper conductor penetrated into the insulating layer via gaps in the layers.

The invention claimed is:

1. A power cable comprising:

a conductor;

an inner semi-conductive layer covering the conductor;

an insulating layer covering the inner semi-conductive layer;

an outer semi-conductive layer covering the insulating layer;

a metal sheath layer covering the outer semi-conductive layer;

and a cable protection layer covering the metal sheath layer, wherein the inner semi-conductive layer comprises a plurality of layers formed by horizontally winding semi-conductive paper, wherein the plurality of layers comprise at least one layer formed by overlap-winding the semi-conductive paper such that portions of a width of the semi-conductive paper overlap each other, when the semi-conductive paper is horizontally wound, wherein a total width of the inner semi-conductive layer is in a range of 0.2 to 1.5 mm.

2. The power cable of claim 1, wherein remaining layers of the plurality of layers of the inner semi-conductive layer, other than the at least one layer formed by overlap-winding the semi-conductive paper, comprise layers formed by gap-winding semi-conductive paper such that regular gaps are formed between portions of the horizontally wound semi-conductive paper and the gaps in a certain layer are covered with sheets of semi-conductive paper forming layers above and below the certain layer.

3. The power cable of claim 1, wherein the at least one layer formed by overlap-winding the semi-conductive paper comprises a layer directly above the conductor.

4. The power cable of claim 1, wherein an overlap ratio of the at least one layer formed by overlap-winding the semi-conductive paper is in a range of 20 to 80%, the overlap ratio being a ratio between overlapping portions of the semi-conductive paper and a width of the semi-conductive paper.

5. The power cable of claim 1, wherein a number of the plurality of layers of the semi-conductive paper is in a range of 4 to 10, and the semi-conductive paper has a width of 15 to 30 mm.

6. The power cable of claim 1, wherein the semi-conductive paper comprises carbon paper obtained by processing insulating paper with carbon black.

7. The power cable of claim 1, wherein the insulating layer comprises a plurality of layers formed by horizontally winding insulating paper, wherein the plurality of layers comprise layers formed by gap-winding the insulating paper such that regular gaps are formed between portions of the horizontally wound insulating paper and the gaps in a certain layer are covered with sheets of insulating paper forming layers above and below the certain layer.

8. The power cable of claim 7, wherein the insulating layer comprises an inner insulating layer, an intermediate insulating layer, and an outer insulating layer which are sequentially stacked, wherein each of the inner insulating layer and the outer insulating layer is formed of kraft paper impregnated with insulating oil, the intermediate insulating layer is formed by semi-synthetic paper impregnated with the insulating oil, wherein the semi-synthetic paper comprises:

a plastic film; and kraft paper stacked on at least one surface of the plastic film, and the inner insulating layer and the outer insulating layer have resistivity lower than that of the intermediate insulating layer.

9. The power cable of claim 8, wherein a thickness of the inner insulating layer is 1 to 10% of a total thickness of the insulating layer, a thickness of the intermediate insulating layer is 75% or more of the total thickness of the insulating layer, and a thickness of the outer insulating layer is 5 to 15% of the total thickness of the insulating layer.

10. The power cable of claim 9, wherein the thickness of the outer insulating layer is greater than that of the inner insulating layer.

11. The power cable of claim 1, wherein the cable protection layer comprises an inner sheath, bedding layers, a metal reinforcement layer, and an outer sheath.

12. The power cable of claim 11, wherein the cable protection layer further comprises a wire sheath and an outer serving layer.

* * * * *